US011246364B2

(12) United States Patent
Kim et al.

(10) Patent No.: US 11,246,364 B2
(45) **Date of Patent: *Feb. 15, 2022**

(54) HAIR EXTENSION APPARATUS

(71) Applicant: SHAKE-N-GO FASHION, INC., Port Washington, NY (US)

(72) Inventors: James K. Kim, Manhasset, NY (US); Susan Kim, Manhasset, NY (US); Jason Kim, Manhasset, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/228,196

(22) Filed: Apr. 12, 2021

(65) Prior Publication Data

US 2021/0227909 A1 Jul. 29, 2021

Related U.S. Application Data

(63) Continuation of application No. 16/692,479, filed on Nov. 22, 2019, now Pat. No. 10,993,493, which is a (Continued)

(51) Int. Cl.
*A41G 5/00* (2006.01)

(52) U.S. Cl.
CPC ..... *A41G 5/0046* (2013.01); *A41G 5/0073* (2013.01)

(58) Field of Classification Search
CPC ..... A61K 34/12; A61K 47/6829; A61K 47/6851; A61K 2039/55516; A61K 2039/6037; A61K 31/015; A61K 31/045; A61K 31/05; A61K 31/085; A61K 31/122; A61K 31/11; A61K 31/12; A61K 31/216; A61K 31/22; A61K 31/35; A61K 31/496; A61K 38/164; A61K 38/1764;
(Continued)

(56) References Cited

U.S. PATENT DOCUMENTS 3,910,292 A * 10/1975 Izzo ..... A41G 5/0093 132/53
5,647,384 A * 7/1997 Haber ..... A41G 5/00 132/105

(Continued)

FOREIGN PATENT DOCUMENTS

KR 10-1821386 * 1/2018 ..... A41G 3/0016

*Primary Examiner* — Nicholas D Lucchesi
(74) *Attorney, Agent, or Firm* — Cowan, Liebowitz & Latman, P.C.; Mark Montague; Brian R. Volk

(57) ABSTRACT

A hair extension apparatus, comprising: a first base member comprising a first front edge, a first rear edge, a first side edge, a first top surface and a first bottom surface; a second base member comprising a second front edge, a second rear edge, a second side edge, a second top surface and a second bottom surface, wherein the second base member is coupled to the first base member; a first artificial hair section comprising artificial hair, wherein the first artificial hair section is coupled to the first top surface of the first base member; a second artificial hair section comprising artificial hair, wherein the second artificial hair section is coupled to the second top surface of the second base member; and a first fastener member coupled to the first side edge on the first bottom surface of the first base member.

30 Claims, 16 Drawing Sheets

Related U.S. Application Data continuation of application No. PCT/US2019/061234, filed on Nov. 13, 2019.

(60) Provisional application No. 62/912,176, filed on Oct. 8, 2019, provisional application No. 62/890,330, filed on Aug. 22, 2019, provisional application No. 62/857,945, filed on Jun. 6, 2019, provisional application No. 62/760,289, filed on Nov. 13, 2018.

(58) Field of Classification Search

CPC ..... A61K 38/177; A61K 47/10; A61K 47/14; A61K 47/20; A61K 47/32; A61K 47/40; A61K 47/6415; A61K 47/6849; A61K 49/00; A61K 9/0014; A61K 9/0056; A61K 36/534; A61K 36/9068; A61K 39/0011; A61K 2039/572; A45D 8/36; A45D 44/00; A41G 5/004; A41G 5/005; A41G 5/0046; A41G 5/0073; A41G 3/0066; A41G 5/006; A41G 5/0086; A41G 3/0075; A41G 3/0033; A41G 5/0093; A41G 3/00; A41G 5/0006; A41G 5/0053; A41G 5/0026; A41G 5/0013; A41G 3/0083; A41G 3/0016; A41G 3/0041

USPC ..... 132/53, 201, 105; 2/171–200.3

See application file for complete search history.

(56) References Cited

U.S. PATENT DOCUMENTS 5,899,211 A * 5/1999 Brown ..... A41G 5/00 132/201
6,263,884 B1 * 7/2001 Minnelli ..... A45D 8/34 132/201
7,735,495 B2 * 6/2010 Lane ..... A45D 8/00 132/53
8,584,682 B1 * 11/2013 Naylor ..... A41G 5/0093 132/54
9,138,024 B1 * 9/2015 Solomon ..... A41G 5/0073
10,327,493 B2 * 6/2019 Robertson ..... A41G 3/005
2007/0272263 A1 * 11/2007 Gold ..... A41G 5/0086 132/201
2008/0047572 A1 * 2/2008 Park ..... A41G 3/00 132/53
2008/0178902 A1 * 7/2008 Moeszinger ..... A45D 8/36 132/273
2008/0257369 A1 * 10/2008 Poole ..... A41G 5/004 132/53
2008/0264435 A1 * 10/2008 Kugel ..... A41G 3/00 132/56
2009/0188512 A1 * 7/2009 Eaton ..... A41G 5/0073 132/54
2009/0235945 A1 * 9/2009 Eaton ..... A45D 8/00 132/105
2010/0065078 A1 * 3/2010 Reece ..... A41G 5/006 132/54
2011/0180091 A1 * 7/2011 Wilson ..... A41G 3/0033 132/201
2013/0247930 A1 * 9/2013 Norman ..... A41G 5/0073 132/201
2015/0013710 A1 * 1/2015 Buzaglo ..... A41G 5/0093 132/201
2015/0040935 A1 * 2/2015 Sumpter ..... A41G 5/0073 132/201
2015/0189936 A1 * 7/2015 Murphy ..... A41G 5/0046 132/201
2015/0223538 A1 * 8/2015 Yanniello ..... A41G 5/0026 132/53
2015/0257469 A1 * 9/2015 Curbeon ..... A41G 5/0053 132/54
2015/0327611 A1 * 11/2015 Kleinman ..... A41G 5/0073 132/201
2016/0143381 A1 * 5/2016 Helmers ..... A41G 5/0073 132/53
2016/0278497 A1 * 9/2016 Sonstegard ..... A45D 8/06
2018/0035738 A1 * 2/2018 Hayes ..... A41G 5/0046
2018/0103740 A1 * 4/2018 Kennedy ..... A45D 8/36
2019/0059487 A1 * 2/2019 Kim ..... A41G 5/0046

* cited by examiner

HAIR EXTENSION APPARATUS

CROSS-REFERENCE TO RELATED APPLICATIONS

This application is a continuation application of U.S. application Ser. No. 16/692,479, filed on Nov. 22, 2019, which is a continuation application of PCT/US2019/061234, filed on Nov. 13, 2019, which claims priority to U.S. Provisional Application No. 62/760,289, filed on Nov. 13, 2018, U.S. Provisional Application No. 62/857,945, filed on Jun. 6, 2019, U.S. Provisional Application No. 62/890,330, filed on Aug. 22, 2019, and U.S. Provisional Application No. 62/912,176, filed on Oct. 8, 2019. The entire content of each of the above patent applications is incorporated herein by reference.

BACKGROUND OF THE INVENTION

Field of the Invention

The present invention relates generally to hair extensions, and more particularly, to a hair extension apparatus that is coupled to a user's natural hair.

Description of the Related Art

Hair extensions and wigs are used by people to enhance their appearance. Wigs generally include multiple strands of hair attached to a cap to form a unit that can be secured to an user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Hair extensions and wigs are also used to provide a user with an alternative hair color in order to improve their appearance. Furthermore, hair extensions and wigs can be used by people to present an alternative texture to their own hair, such as changing their hair from straight to curly. Just as many people enjoy accessorizing their wardrobe, people who wear hair extensions and wigs enjoy changing and enhancing their appearance.

SUMMARY OF THE INVENTION

Embodiments of the invention described herein provide a hair extension apparatus. The hair extension apparatus, comprises: a first base member comprising a first front edge, a first rear edge, a first side edge, a first top surface and a first bottom surface; a second base member comprising a second front edge, a second rear edge, a second side edge, a second top surface and a second bottom surface, wherein the second base member is coupled to the first base member; a first artificial hair section comprising artificial hair, wherein the first artificial hair section is coupled to the first top surface of the first base member; a second artificial hair section comprising artificial hair, wherein the second artificial hair section is coupled to the second top surface of the second base member; and a first fastener member coupled to the first side edge on the first bottom surface of the first base member, wherein the first fastener member is disposed opposite to the second base member, wherein the first fastener member is a first comb comprising tines, and wherein the tines of the first comb face towards the second base member.

According to further embodiments: a second fastener member is coupled to the first bottom surface of the first base member, wherein the second fastener member is a second comb comprising tines; the tines of the first comb are disposed perpendicular to the tines of the second comb; the first artificial hair section comprises individual strands of artificial hair coupled to a first filament section, and wherein the first filament section is coupled to the first base member; the first filament section is coupled to the top surface of the first base member in multiple rows; the first filament section is coupled to the first base member in one of a parallel, perpendicular and diagonal orientation with respect to the first front edge and the second filament section is coupled to the second base member in one of a parallel, perpendicular and diagonal orientation with respect to the second front edge; the second artificial hair section comprises individual strands of artificial hair coupled to a second filament section, and wherein the second filament is coupled to the second base member; the second filament section is coupled to the top surface of the second base member in multiple rows; the first filament section is coupled to the first base member in one of a parallel, perpendicular and diagonal orientation with respect to the first front edge and the second filament section is coupled to the second base member in one of a parallel, perpendicular and diagonal orientation with respect to the second front edge; the first filament section is coupled to the first base member with respect to the first front edge in an orientation different from an orientation in which the second filament section is coupled to the second base member with respect to the second front edge; the artificial hair of the first artificial hair section extends in a direction perpendicular to a direction in which the artificial hair of the second artificial hair section extends; the first top surface comprises a greater surface area than the second top surface; the first front edge is substantially perpendicular to the second front edge, and wherein the first rear edge is substantially perpendicular to the second rear edge; the artificial hair of the first artificial hair section extends at least partially beyond the first rear edge, and wherein the artificial hair of the second artificial hair section extends at least partially beyond the second rear edge; the first base member is configured to wrap around a user's natural hair, with the first bottom surface of the first base member being in contact with the user's natural hair, and wherein the second base member, and the artificial hair extending therefrom, is configured to wrap around the first base member, with the second bottom surface of the second base member being in contact with the first artificial hair section; a portion of the second top surface of the second base member is free of artificial hair; the first base member and the second base member are constructed of separate pieces of material; and at least a portion of the second base member is constructed of an elastic material.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors.

The term "user," as used herein, refers to any purchaser of the wig configured according to any of the embodiments disclosed herein, including, but not limited to, individual members of the public, wholesale distributors, retail merchants, manufacturers, importers and exporters of the wig and related components of the wig.

Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

Embodiments of the invention described herein provide a hair extension apparatus that is coupled to a user's natural hair. The hair extension apparatus includes various components configured to securely couple the hair extension apparatus to the user's natural hair, while also providing a desirable and fashionable appearance.

Figure 1:
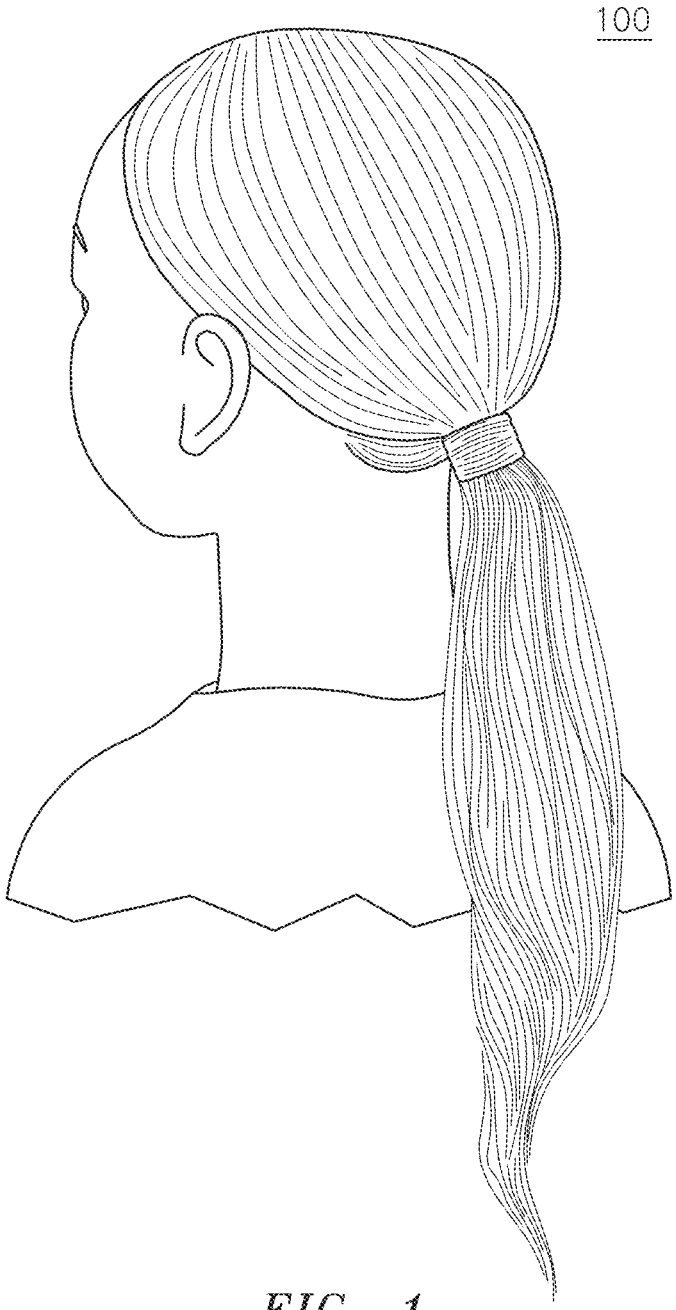
FIG. 1 illustrates a rear perspective view of a hair extension apparatus worn by a user, according to an embodiment of the invention.

FIG. 1 illustrates a rear perspective view of a hair extension apparatus 100 worn by a user, according to an embodiment of the invention. The hair extension apparatus 100 couples to the user's natural hair, as further described herein, providing the user with desirable and natural appearing long hair.

Figure 2:
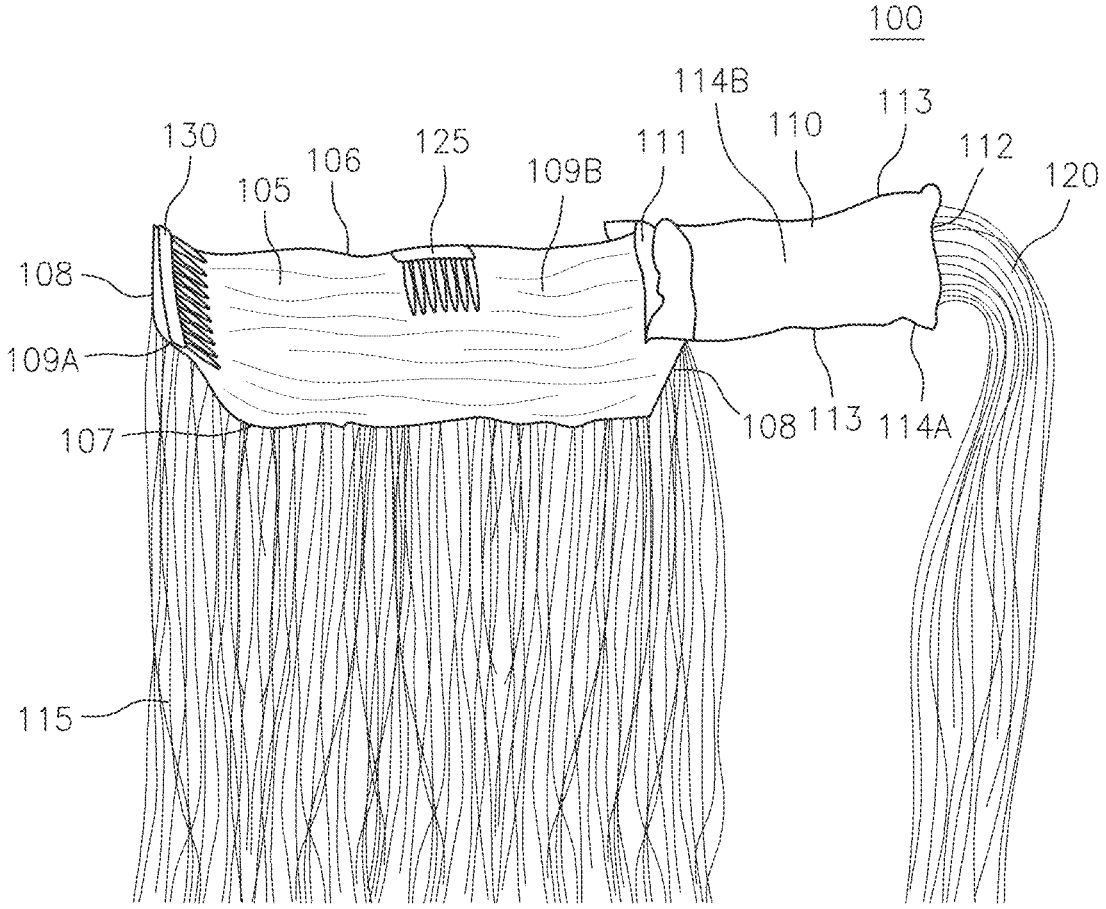
FIG. 2 illustrates a bottom view of the hair extension apparatus, disengaged from the user's hair and in an open configuration for purposes of illustration.
Figure 3:
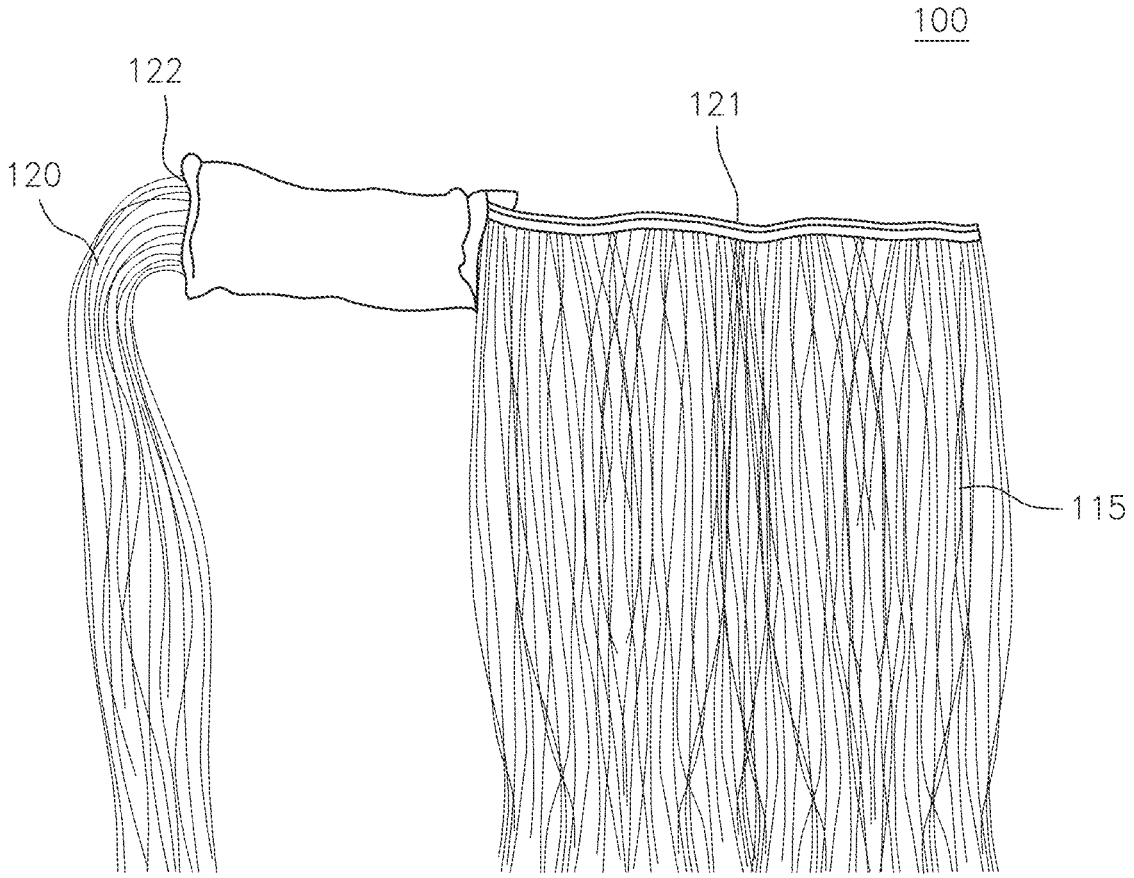
FIG. 3 illustrates a top view of the hair extension apparatus, also disengaged from the user's hair and in an open configuration.

FIG. 2 illustrates a bottom view of the hair extension apparatus 100, disengaged from the user's hair and in an open configuration for purposes of illustration. FIG. 3 illustrates a top view of the hair extension apparatus 100, also disengaged from the user's hair and in an open configuration. The hair extension apparatus 100 includes a first base member 105, a second base member 110, a first artificial hair section 115, a second artificial hair section 120, a first fastener member 125, and a second fastener member 130.

The first base member 105 includes a first front edge 106, a first rear edge 107, a first side edge 108, a first top surface 109A and a first bottom surface 109B. The first base member 105 is constructed of a fine mesh. In certain embodiments, the first base member 105 is constructed of silk mesh, cotton mesh, nylon mesh or other suitable material and combinations thereof. The first artificial hair section 115 is coupled to the first top surface 109A of the first base member 105. It is noted that in certain embodiments, the first artificial hair section 115 can be constructed of various materials, including human hair, animal hair and synthetic hair, and combinations thereof. The first artificial hair section 115 can be curly, straight, or other suitable texture.

In certain embodiments, the first artificial hair section 115 includes individual strands of artificial hair coupled to a first filament section 121. The first filament section 121 is coupled to the first top surface 109A of the base member 105. The "filament" refers to a cylindrical strip of material, e.g., string, constructed of cotton, nylon, or other suitable material, and is coupled to the top surface 109A of the first base member 105 in multiple rows. In certain embodiments, the first filament section 121 is coupled to the first base member 105 in at least five rows, about five to fifteen rows, or about 10 rows, though the number of rows is not limited and can be adjusted according to individual needs and applications. The first filament section 121 may be coupled to the first base member 105 in multiple separate rows in which the first filament section 121 includes multiple separate sections of material. In certain embodiments, the first filament section 121 includes one section of material that is coupled to the first base member 105. In certain embodiments, the first filament section 121 includes one section of material that is coupled to the first base member 105 in a serpentine manner. In certain embodiments, there is sufficient artificial hair in the first artificial hair section 115 to cover the entire surface of the first base member 105.

The second base member 110 includes a second front edge 111, a second rear edge 112, a second side edge 113, a second top surface 114A and a second bottom surface 114B. The second base member 110 is constructed of a fine mesh. In certain embodiments, the second base member 110 is constructed of silk mesh, cotton mesh, nylon mesh or other suitable material and combinations thereof. In certain embodiments, the second base member 110 is constructed of an elastic material such as, for example, stocking material. In certain embodiments, the first base member 105 and the second base member 110 are constructed of the same material. In certain embodiments, the first base member 105 and the second base member 110 are constructed of different types of materials. The second artificial hair section 120 is coupled to the second top surface 114A of the second base member 110. It is noted that in certain embodiments, the second artificial hair section 120 can be constructed of various materials, including human hair, animal hair and synthetic hair, and combinations thereof. The second artificial hair section 120 can be curly, straight, or other suitable texture.

In certain embodiments, the first top surface 109A has a greater surface area than the second top surface 114A. In other words, the first top surface 109A is larger in size than the second top surface 114A.

In certain embodiments, the first front edge 106 is substantially perpendicular to the second front edge 111. That is, as illustrated in FIG. 2, the first front edge 106 is substantially a straight line and the second front edge 111 is substantially a straight line. Thus, the straight line formed by the first front edge 106 is substantially perpendicular to the straight line formed by the second front edge 111. It is noted that, in certain embodiments, the first front edge 106 and the second front edge 111 may be embodied as a curved line or a line with one or more angles.

In certain embodiments, the first rear edge 107 is substantially perpendicular to the second rear edge 112. That is, as illustrated in FIG. 2, the first rear edge 107 is substantially a straight line and the second rear edge 112 is substantially a straight line. Thus, the straight line formed by the first rear edge 107 is substantially perpendicular to the straight line formed by the second rear edge 112. It is noted that, in certain embodiments, the first rear edge 107 and the second rear edge 112 may be embodied as a curved line or a line with one or more angles.

It is noted that where the first front edge 106 is substantially perpendicular to the second front edge 111, the first rear edge 107 may also be substantially perpendicular to the second rear edge 112, though it is not required. In certain embodiments, the first front edge 106 is substantially perpendicular to the second front edge 111 and the first rear edge 107 is not substantially perpendicular to the second rear edge 112. In certain embodiments, the first front edge 106 is not substantially perpendicular to the second front edge 111 and the first rear edge 107 is substantially perpendicular to the second rear edge 112.

In certain embodiments, the artificial hair of the first artificial hair section 115 extends at least partially beyond the first rear edge 107. That is, the artificial hair of the first artificial hair section 115 is of a sufficient length to extend at least partially beyond the first rear edge 107. In certain embodiments, the artificial hair of the second artificial hair section 120 extends at least partially beyond the second rear edge 112. That is, the artificial hair of the second artificial hair section 120 is of a sufficient length to extend at least partially beyond the second rear edge 112.

In certain embodiments, the second base member 110 is coupled to the left side of the first base member 105 or the right side of the first base member 105.

In certain embodiments, the second base member 110 is coupled to both the left side and the right side of the first base member 105. When the second base member 110 is coupled to both the left side and the right side of the first base member 105, one of the second base members is coupled the first base member 105 off-set to the other second base member. That is, one of the second base members is coupled to the first base member 105 closer to the first front edge 106 and the other second base member is coupled to the first base member 105 closer to the first rear edge 107. In this configuration, the two second base members do not overlap when they are wrapped around the first base member 105.

In certain embodiments, the second artificial hair section 120 includes individual strands of artificial hair coupled to a second filament section 122. The second filament section 122 is coupled to the second base member 110. The "filament" refers to a cylindrical strip of material, e.g., string, constructed of cotton, nylon, or other suitable material, coupled to the top surface 114A of the second base member 110 in multiple rows. In certain embodiments, the second filament section 122 is coupled to the second base member 110 in at least one row, about two to ten rows, or about five rows, though the number of rows is not limited and can be adjusted according to individual needs and applications. The second filament section 122 may be coupled to the second base member 110 in multiple separate rows in which the second filament section 122 includes multiple separate sections of material. In certain embodiments, the second filament section 122 includes one section of material that is coupled to the second base member 110 in a serpentine manner.

In certain embodiments, there is sufficient artificial hair in the second artificial hair section 120 to cover the entire surface of the second base member 110. In certain embodiments, there is insufficient artificial hair in the second artificial hair section 120 to cover the entire surface of the second base member 110. In other words, the artificial hair of the second artificial hair section 120 partially covers the surface of the second base member 110, with a portion of the surface of the second base member 110 being free of artificial hair.

The second base member 110 is coupled to the first base member 105. In certain embodiments, the second base member 110 is sewn, glued, or otherwise attached in a non-removable manner to the first base member 105. The top surface of the second base member 110 contacts the bottom surface of the first base member 105 at the location where second base member 110 is coupled to the first base member 105. The top surface of the second base member 110 refers to the surface upon which the second artificial hair section 120 is coupled. The top surface of the first base member 105 refers to the surface upon which the first artificial hair section 115 is coupled.

In certain embodiments, when the hair extension apparatus 100 is in the open configuration, the second base member 110 is coupled to the first base member 105 in such a manner that artificial hair of the first artificial hair section 115 is disposed adjacent to the artificial hair of the second artificial hair section 120. In other words, the artificial hair of the first artificial hair section 115 is coupled to the first base member 105, and the artificial hair of the second artificial hair section 120 is coupled to the second base member 110, in such a manner that that the artificial hair of the first artificial hair section 115 extends in a direction perpendicular to a direction in which the artificial hair of the second artificial hair section 120 extends.

The first fastener member 125 and the second fastener member 130 are coupled to the bottom surface of the first base member 105. The first fastener member 125 is coupled to the first front edge 106. The second fastener member 130 is coupled to the first side edge 108 on the side opposite to the second base member 110. In certain embodiments, the first fastener member 125 and the second fastener member 130 are combs, clips, pins, or other suitable device configured to secure the hair extension apparatus 100 to the user's natural hair. In certain embodiments, the first fastener member 125 and the second fastener member 130 are combs that include tines. The tines of the first fastener member 125 are disposed adjacent to the tines of the second fastener member 130.

In FIG. 2, the first fastener member 125 and the second fastener member 130 are illustrated as being parallel to the edge of the first base member 105. In certain embodiments, the first fastener member 125 and the second fastener member 130 are coupled to the first base member 105 perpendicular to the edge thereof. In certain embodiments, the first fastener member 125 and the second fastener member 130 are coupled to the first base member 105 at an angle greater than or less than perpendicular to the edge thereof.

The hair extension apparatus 100 is used by a user by first wrapping the first base member 105 around their natural hair, with the bottom surface of the first base member 105 being in contact with the user's natural hair. The user's natural hair can be styled in, for example, a bun or a pony tail. When the first base member 105 is fully wrapped around the user's natural hair, the second base member 110 is wrapped around the first base member 105, with the bottom surface of the second base member 110 being in contact with the first base member 105 and/or the first artificial hair section 115. The second artificial hair section 120 is then wrapped around the second base member 110. In this manner, the user is able to couple the hair extension apparatus to their natural hair and obtain the style illustrated in FIG. 1.

In other words, in certain embodiments, the first base member 105 is configured to wrap around a user's natural hair, with the bottom surface 109B of the first base member 105 being in contact with the user's natural hair. In certain embodiments, the second base member 110 is configured to wrap around the first base member 105, with the bottom surface 114B of the second base member 110 being in contact with the first artificial hair section 115.

Figure 4:
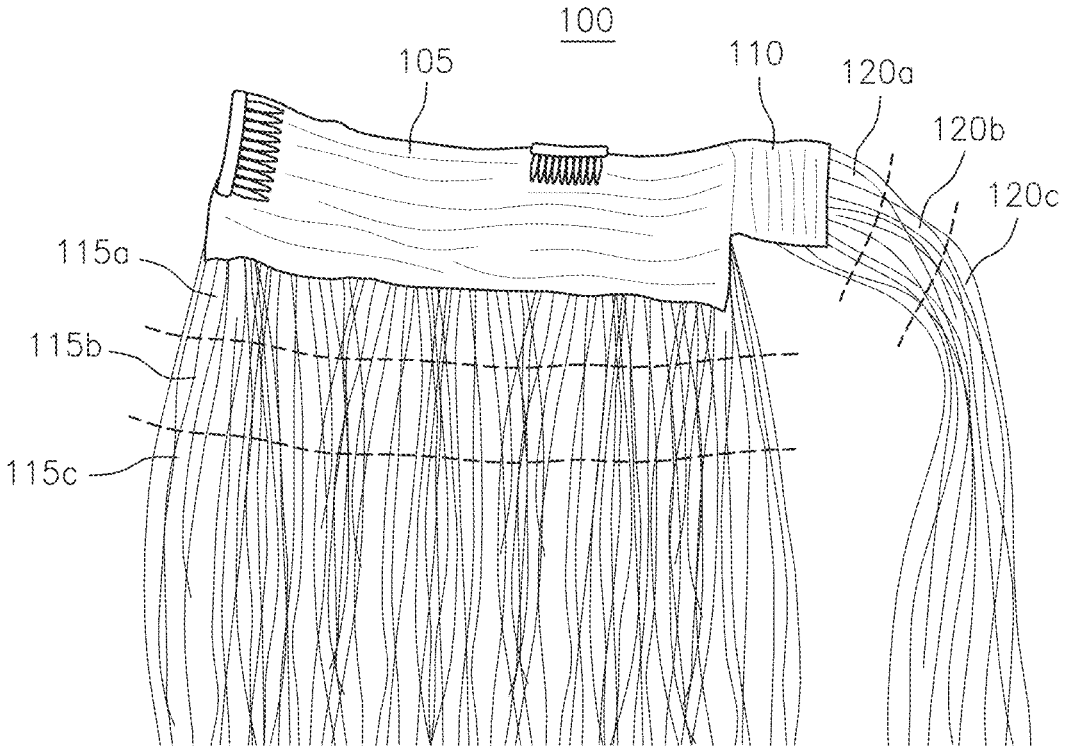
FIG. 4 illustrates a bottom view of the hair extension apparatus, disengaged from the user's hair and in an open configuration, for purposes of illustration, according to an alternative embodiment.
Figure 5:
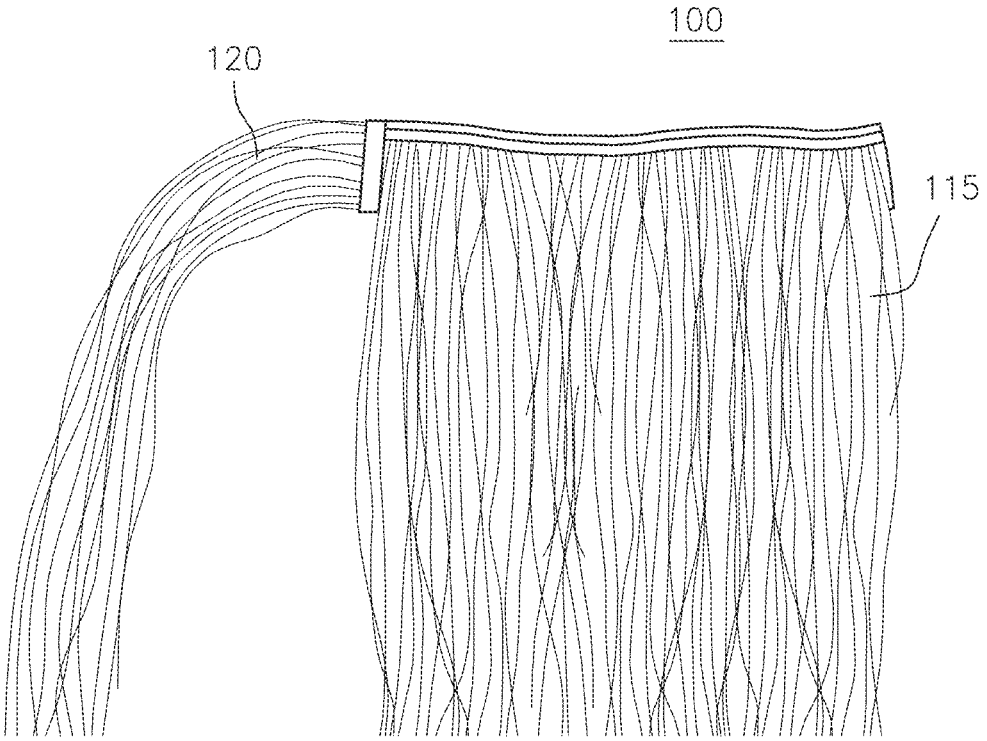
FIG. 5 illustrates a top view of the hair extension apparatus, also disengaged from the user's hair and in an open configuration.

FIG. 4 illustrates a bottom view of the hair extension apparatus 100, disengaged from the user's hair and in an open configuration, for purposes of illustration, in an alternative embodiment of the artificial hair of the first artificial hair section 115 and the artificial hair of the second artificial hair section 120. FIG. 5 illustrates a top view of the hair extension apparatus 100, also disengaged from the user's hair and in an open configuration.

In the embodiment illustrated in FIGS. 4 and 5, the first artificial hair section 115 includes a first color section 115*a*, a second color section 115*b*, and a third color section 115*c*. The first color section 115*a* is the portion of the first artificial hair section 115 that is coupled to the first base member 105. In certain embodiments, the first color section 115*a*, the second color section 115*b*, and the third color section 115*c* are different colors of artificial hair. In the embodiment illustrated in FIGS. 4 and 5, the second color section 115*b* is a blend of the colors of the first color section 115*a* and the third color section 115*c* in which the color of the first color section 115*a* gradually transitions to the color of the third color section 115*c*.

The second artificial hair section 120 includes a fourth color section 120*a*, a fifth color section 120*b*, and a sixth color section 120*c*. The fourth color section 120*a* is the portion of the second artificial hair section 120 that is coupled to the second base member 110. In certain embodiments, the fourth color section 120*a*, the fifth color section 120*b*, and the sixth color section 120*c* are different colors of artificial hair. In the embodiment illustrated in FIGS. 4 and 5, the fifth color section 120*b* is a blend of the colors of the fourth color section 120*a* and the sixth color section 120*c* in which the color of the fourth color section 120*a* gradually transitions to the color of the sixth color section 120*c*.

In certain embodiments, each of the first color section 115*a*, the second color section 115*b*, the third color section 115*c*, the fourth color section 120*a*, the fifth color section 120*b*, and the sixth color section 120*c* are different colors of artificial hair. In certain embodiments, the first color section 115*a* is the same color as the fourth color section 120*a*, the second color section 115*a* is the same color as the fifth color section 120*b*, and the third color section 115*c* is the same color as the sixth color section 120*c*.

In certain embodiments, the first color section 115*a* is substantially the same color as the fourth color section 120*a*, the second color section 115*b* is substantially the same color as the fifth color section 120*b*, and the third color section 115*c* is substantially the same color as the sixth color section 120*c*.

Figure 6:
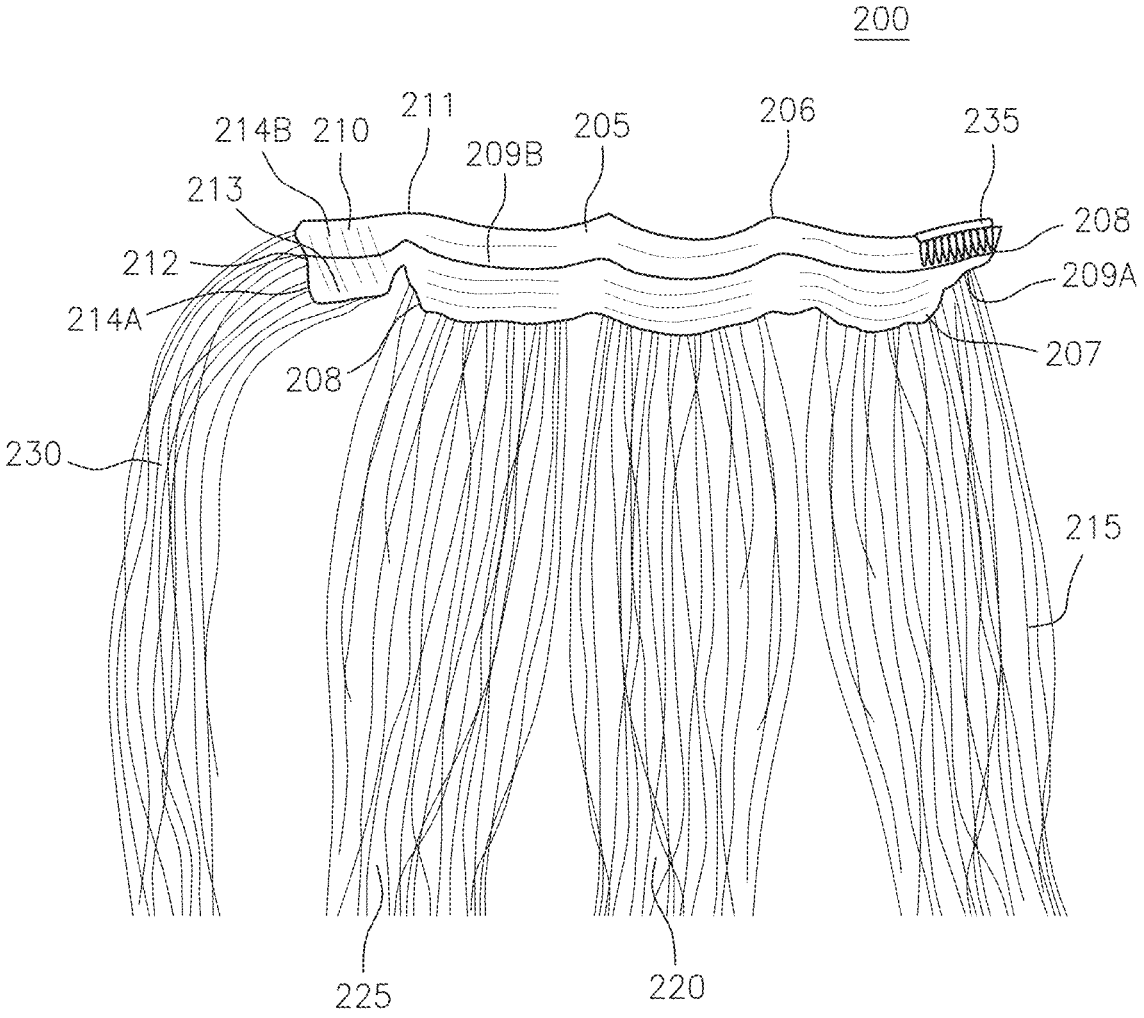
FIG. 6 illustrates a bottom view of a hair extension apparatus, disengaged from the user's hair and in an open configuration, for purposes of illustration, according to an alternative embodiment.
Figure 7:
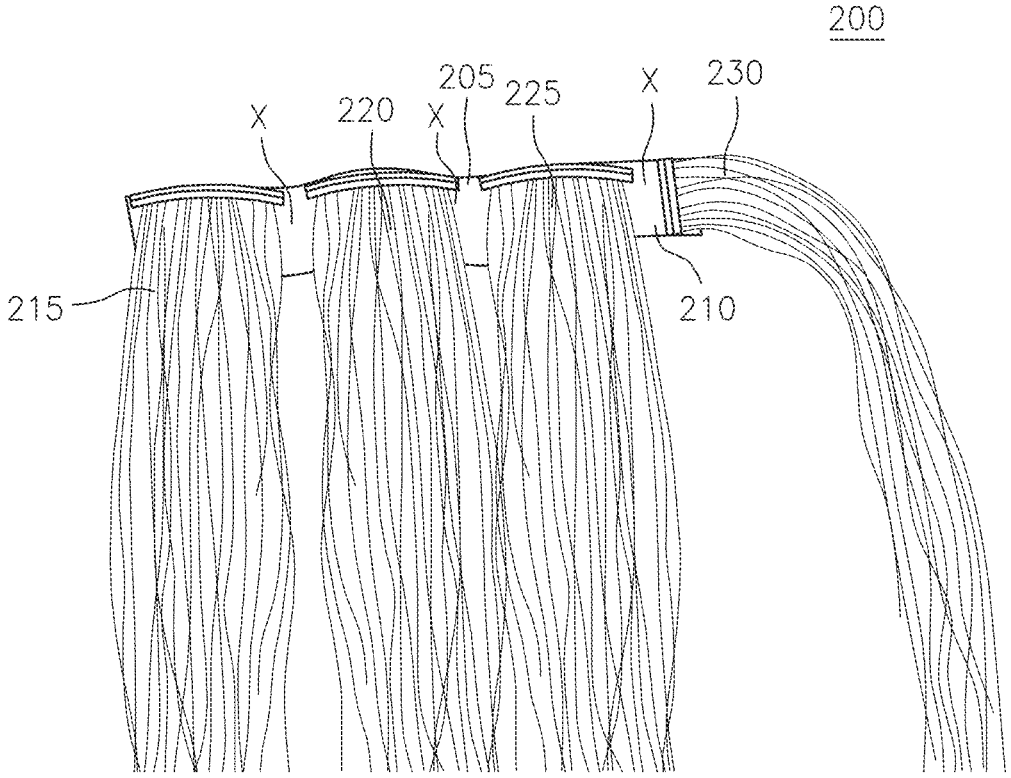
FIG. 7 illustrates a top view of the hair extension apparatus, also disengaged from the user's hair and in an open configuration.

FIG. 6 illustrates a bottom view of a hair extension apparatus 200, disengaged from the user's hair and in an open configuration, for purposes of illustration, in an alternative embodiment. FIG. 7 illustrates a top view of the hair extension apparatus 200, also disengaged from the user's hair and in an open configuration. The hair extension apparatus 200 includes a first base member 205, a second base member 210, a first artificial hair section 215, a second artificial hair section 220, a third artificial hair section 225, a fourth artificial hair section 230, and a fastener member 235.

The first base member 205 includes a first front edge 206, a first rear edge 207, a first side edge 208, a first top surface 209A and a first bottom surface 209B. The first base member 205 is constructed of an elastic material. In certain embodiments, the first base member 205 is constructed of stocking material, silk mesh, cotton mesh, nylon mesh or other suitable material and combinations thereof. The first artificial hair section 215, the second artificial hair section 220 and the third artificial hair section 225 are coupled to first top surface 209A of the first base member 205. It is noted that in certain embodiments, the first artificial hair section 215, the second artificial hair section 220 and the third artificial hair section 225 can be constructed of various materials, including human hair, animal hair and synthetic hair, and combinations thereof. The first artificial hair section 215, the second artificial hair section 220 and the third artificial hair section 225 can be curly, straight, or other suitable texture.

In certain embodiments, the first artificial hair section 215, the second artificial hair section 220 and the third artificial hair section 225 include individual strands of artificial hair coupled to a filament. The filament is coupled to the first base member 205. The filament is a cylindrical strip of material, e.g., string, constructed of cotton, nylon, or other suitable material, and is coupled to the surface of the first base member 205 in multiple rows. In certain embodiments, the filament is coupled to the first base member 205 in at least five rows, about five to fifteen rows, or about 10 rows, though the number of rows is not limited and can be adjusted according to individual needs and applications. The filament may be coupled to the first base member 205 in multiple separate rows in which the filament includes multiple separate sections of material. In certain embodiments, the filament includes one section of material that is coupled to the first base member 205 in a serpentine manner.

The second base member 210 includes a second front edge 211, a second rear edge 212, a second side edge 213, a second top surface 214A and a second bottom surface 214B. The second base member 210 is constructed of an elastic material. In certain embodiments, the second base member 210 is constructed of stocking material, silk mesh, cotton mesh, nylon mesh or other suitable material and combinations thereof. In certain embodiments, the first base member 205 and the second base member 210 are constructed of the same material. In certain embodiments, the first base member 205 and the second base member 210 are constructed on one continuous piece of material. In certain embodiments, the first base member 205 and the second base member 210 are constructed of separate pieces of material. The fourth artificial hair section 230 is coupled to the second top surface 214A of the second base member 210. It is noted that in certain embodiments, the fourth artificial hair section 230 can be constructed of various materials, including human hair, animal hair and synthetic hair, and combinations thereof. The fourth artificial hair section 230 can be curly, straight, or other suitable texture.

In certain embodiments, the fourth artificial hair section 230 includes individual strands of artificial hair coupled to a filament. The filament is coupled to the second base member 210. The filament is a cylindrical strip of material, e.g., string, constructed of cotton, nylon, or other suitable material coupled to the surface of the second base member 210 in multiple rows. In certain embodiments, the filament is coupled to the second base member 210 in at least one row, about two to ten rows, or about five rows, though the number of rows is not limited and can be adjusted according to individual needs and applications. The filament may be coupled to the second base member 210 in multiple separate rows in which the filament includes multiple separate sections of material. In certain embodiments, the filament includes one section of material that is coupled to the second base member 210 in a serpentine manner.

In certain embodiments, there is sufficient artificial hair in the fourth artificial hair section 230 to cover the entire surface of the second base member 210. In certain embodiments, there is insufficient artificial hair in the fourth artificial hair section 230 to cover the entire surface of the second base member 210. In other words, the artificial hair of the fourth artificial hair section 230 partially covers the surface of the second base member 210, with a portion of the surface of the second base member 210 being free of artificial hair.

In certain embodiments, the second base member 210 is coupled to the left side of the first base member 205 or the right side of the first base member 205. In certain embodiments, the second base member 210 is coupled to both the left side and the right side of the first base member 205.

In certain embodiments, the second base member 210 is coupled to the first base member 105. In certain embodiments, the second base member 210 is sewn, glued, or otherwise attached in a non-removable manner to the first base member 205. The top surface of the second base member 210 contacts the bottom surface of the first base member 205. The top surface of the second base member 210 refers to the surface upon which the second artificial hair section 220 is coupled. The bottom surface of the first base member 205 refers to the surface upon which the first artificial hair section 215 is coupled.

In certain embodiments, when the hair extension apparatus 200 is in the open configuration, the second base member 210 is coupled to the first base member 205 in such a manner that artificial hair of the first artificial hair section 215, the second artificial hair section 220 and the third artificial hair section 225 is disposed adjacent to the artificial hair of the fourth artificial hair section 230. In other words, the artificial hair of the first artificial hair section 215, the second artificial hair section 220 and the third artificial hair section 225 extends in a direction perpendicular to a direction in which the artificial hair of the fourth artificial hair section 230 extends. Thus, when the hair extension apparatus 200 is in the closed configuration, the artificial hair of the fourth artificial hair section 230 wraps around the artificial hair of the first artificial hair section 215, the second artificial hair section 220 and the third artificial hair section 225.

The hair extension apparatus 200 is used by a user in a similar manner as described above with respect to the hair extension apparatus 100 to obtain the style illustrated in FIG. 1. However, as illustrated in FIG. 7, there are spaces, denoted by "X", disposed between each of the first artificial hair section 215, the second artificial hair section 220, the third artificial hair section 225, and the fourth artificial hair section 230. The spaces X may be about 0.1 to about 2 inches, or about 1 inch, or about 0.5 inches. Each space "X" is free of artificial hair.

It is noted that although the embodiment illustrated in FIGS. 6 and 7 show three artificial hair sections coupled to the first base member 205, any number of artificial hair sections can be implemented, such as two, three, four, five, and up to ten or more, according to additional embodiments of the invention.

In certain embodiments, the first base member 205 includes a space between at least one of the first artificial hair section 215, the second artificial hair section 220, and the third artificial hair section 225.

In certain embodiments, the space between at least one of the first artificial hair section 215, the second artificial hair section 220, and the third artificial hair section 225 is constructed of an elastic material.

In certain embodiments, the space between at least one of the first artificial hair section 215, the second artificial hair section 220, and the third artificial hair section 225 is free of artificial hair coupled to the first top surface 209A.

In certain embodiments, the first base member 205 includes a space between the third artificial hair section 225 and the fourth artificial hair section 230.

In certain embodiments, there are additional separate sections of artificial hair coupled to the first base member 205. In FIG. 7, three separate sections of artificial hair, the first artificial hair section 215, the second artificial hair section 220, the third artificial hair section 225, are coupled to the first base member 205, however, there can be at least three separate sections of artificial hair, three to ten separate sections of artificial hair, or greater than ten separate sections of artificial hair. In certain embodiments, there are less than three separate sections of artificial hair coupled to the first base member 205. In certain embodiments, there at least two separate sections of artificial hair coupled to the first base member 205.

The spaces X allow for the first base member 205 and the second base member 210 to be stretched. The positions where the first artificial hair section 215, the second artificial hair section 220, the third artificial hair section 225 are coupled to the first base member 205 are somewhat rigid in that the first base member 205 does not easily stretch. Similarly, the position where the fourth artificial hair section 230 is coupled to the second base member 210 is somewhat rigid in that the second base member 210 does not easily stretch. Thus, when the first base member 205 is wrapped around the user's natural hair, the user is able to pull the first base member 205 tighter to their natural hair in those spaced sections. Similarly, when the second base member 210 is wrapped around the user's natural hair, the second base member 210 can be pulled tight around the first base member 205.

The fastener member 235 is coupled to the bottom surface of the first base member 205. In certain embodiments, the fastener member 235 is a comb, clips, pin, or other suitable device configured to secure the hair extension apparatus 200 to the user's natural hair. In FIG. 6, the fastener member 235 is illustrated as being parallel to the edge of the first base member 205. In certain embodiments, the fastener member 235 is coupled to the first base member 205 perpendicular to the edge thereof. In certain embodiments, the fastener member 235 is coupled to the first base member 205 at an angle greater than or less than perpendicular to the edge thereof.

Figure 8:
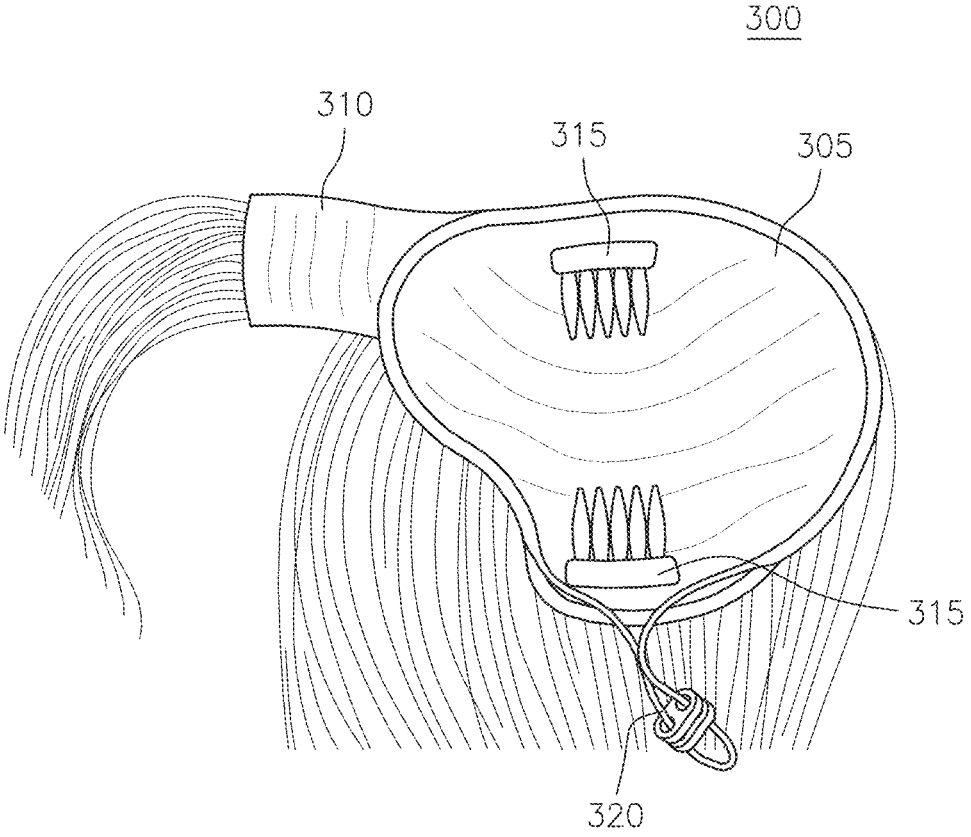
FIGS. 8 and 9 illustrate a bottom view and a top view, respectively, of a hair extension apparatus, according to an alternative embodiment.
Figure 9:
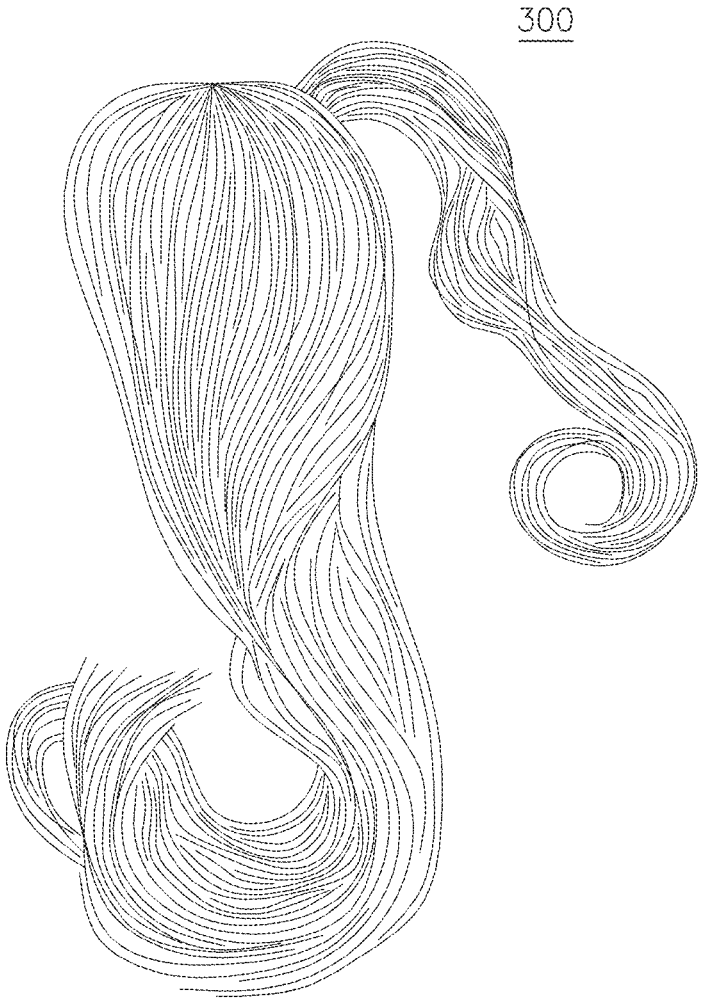

FIGS. 8 and 9 illustrate a bottom view and a top view, respectively, of a hair extension apparatus 300, according to an alternative embodiment. The hair extension apparatus 300 includes a first base member 305, a second base member 310, multiple combs 315, and a drawstring member 320.

The first base member 305 and the second base member 310 are constructed of a mesh material, such as cotton mesh, nylon mesh, or other suitable material and combinations thereof. The color, shape, thickness, flexibility and elasticity of the mesh material can vary according to the particular application. Artificial hair is coupled to the outer surface of the first base member 305 and to the second base member 310. In certain embodiments, the first base member 305 and the second base member 310 are constructed of the same material. In certain embodiments, the first base member 305 and the second base member 310 are constructed of one continuous piece of material. In certain embodiments, the first base member 305 and the second base member 310 are constructed of separate pieces of material.

In certain embodiments, individual strands of artificial hair are coupled to a filament and the filament is coupled to the outer surface of the first base member 305 and the second base member 310. The filament is a cylindrical strip of material, e.g., string, constructed of cotton, nylon, or other suitable material and combinations thereof.

In certain embodiments, the filament is coupled to the first base member 305 and the second base member 310 in at least one row, about two to ten rows, or about five rows, though the number of rows is not limited and can be adjusted according to individual needs and applications. In certain embodiments, the rows are each spaced about 0.1-1.0 inches apart, or about 0.5 inches. The distance between each row may be uniform or the distance between each row may be different. In certain embodiments, the filament coupled to both the first base member 305 and the second base member 310 is one continuous filament. The filament may be coupled to the first base member 305 and the second base member 310 in multiple separate rows in which the filament includes multiple separate sections of material. In certain embodiments, the filament includes one section of material that is coupled separately to the first base member 305 and the second base member 310 in a serpentine manner.

In certain embodiments, there is sufficient artificial hair to cover the entire surface of the first base member 305 and the second base member 310. In certain embodiments, there is insufficient artificial hair in to cover the entire surface of the first base member 305 and the second base member 310. In other words, the artificial hair partially covers the surface of the first base member 305 and the second base member 310, with a portion of the surface of the first base member 305 and the second base member 310 being free of artificial hair.

In certain embodiments, the second base member 310 is coupled to the left side of the first base member 305 or the right side of the first base member 305. In certain embodiments there are multiple of the second base member 310, and at least two of the second base members 310 are coupled to both the left side and the right side of the first base member 305.

The combs 315 are disposed on the inner surface of the first base member 305. The combs 315 are coupled to the inner surface of the first base member 305. In FIG. 8, two of the combs 315 are shown, however, more than two may be implemented and the hair extension apparatus 300 is not limited thereto. The combs 315 include tines that are inserted into the user's hair when the hair extension apparatus 300 is worn by the user. The combs 315 assist with securing the hair extension apparatus 300 to the user's head. The tines of the combs 315 are disposed in opposite directions. In other words, the tines of the combs 315 face each other in a direction towards the center of the first base member 305. In certain embodiments, the tines of the combs 315 face away from each other, towards the outer edge of the first base member 305. In certain embodiments, other devices may be used in place of the combs 315 for securing the hair extension apparatus to the user's hair, such as clips, bobby pins, u-pins or other suitable devices.

The drawstring member 320 is disposed within a sleeve of material around the outer edge of the first base member 305. The drawstring member 320 is a flexible elastic string constructed of, for example, cotton, nylon, or other suitable material and combinations thereof. When the hair extension apparatus 300 is disposed on top of the user's hair, which is configured in, for example, a pony tail or bun, the drawstring member 320 is pulled tight around the user's hair, securing the hair extension apparatus 300 to the user's head. The second base member 310 and the artificial hair coupled to the second base member 310 is wrapped around the user's hair to further secure the hair extension apparatus 300 to the user's hair.

Figure 10:
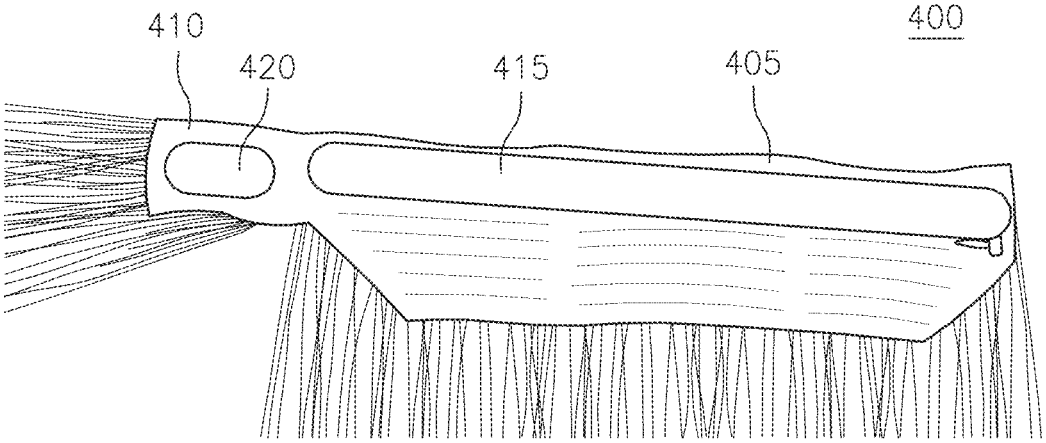
FIGS. 10-12 illustrate a bottom view of a hair extension apparatus including a rubber strip member, according to an alternative embodiment.
Figure 11:
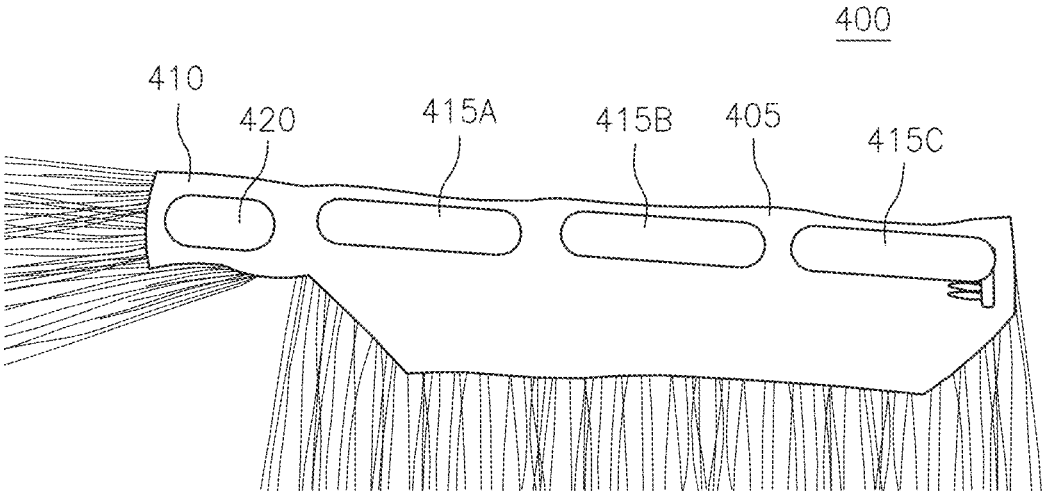
Figure 12:
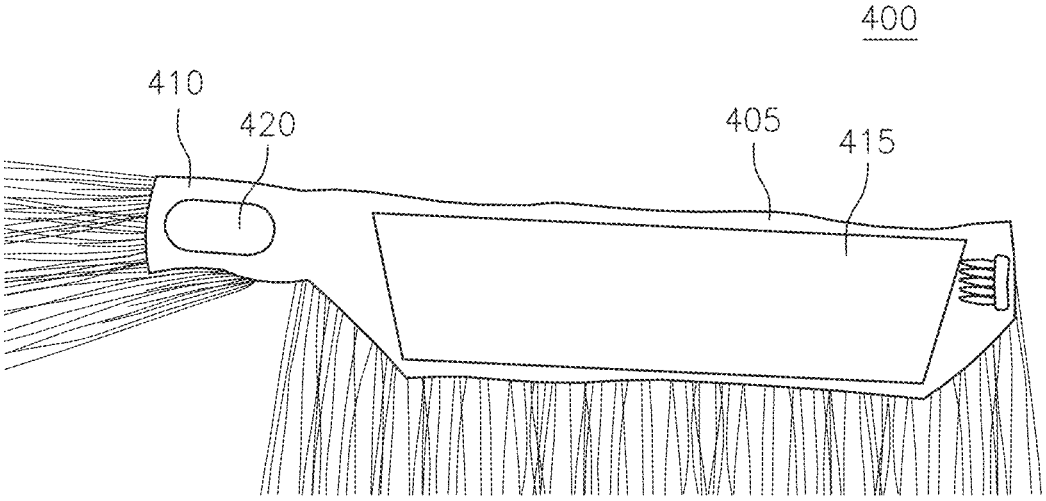

FIGS. 10-12 illustrate a bottom view of a hair extension apparatus 400, according to an alternative embodiment, which can be implemented in each of the above-described embodiments. The hair extension apparatus includes a first base member 405, a second base member 410, a first rubber strip member 415 and a second rubber strip member 420. The first rubber strip member 415 is rigidly attached to the first base member 405. The second rubber strip member 420 is rigidly attached to the second base member 410. The first rubber strip member 415 and the second rubber strip member 420 are constructed of silicone, or other suitable material. The first rubber strip member 415 and the second rubber strip member 420 prevent and/or limit the hair extension apparatus 400 from slipping on the user's head by creating friction between the hair extension apparatus 400 and the user's hair and/or skin.

In FIG. 10, the first rubber strip member 415 extends across the entire width of the first base member 405 up to substantially each edge of the first base member 405 and less than the entire height of the first base member 405. In certain embodiments, the first rubber strip member 415 extends across the first base member 405 less than the entire width. Similarly, the second rubber strip member 420 extends across the entire width of the second base member 410 up to substantially each edge of the second base member 420 and less than the entire height of the second base member 420. In certain embodiments, the second rubber strip member 420 extends across the second base member 410 less than the entire width.

In FIG. 11, the first rubber strip member 415 includes a first rubber strip member 415A, a second rubber strip member 415B and a third rubber strip member 415C. The first rubber strip member 415A, the second rubber strip member 415B and the third rubber strip member 415C extend across the entire width of the first base member 405 with a space between the first rubber strip member 415A and the second rubber strip member 415B and a space between the second rubber strip member 415B and the third rubber strip member 415C. The first rubber strip member 415A is disposed adjacent to one edge of the first base member 405 while the third rubber strip member 415C is disposed adjacent to the opposite edge of the first base member 405, as illustrated. The second rubber strip member 415B is disposed between the first rubber strip member 415A and the third rubber strip member 415C.

In FIG. 12, the first rubber strip member 415 extends across the entire width of the first base member 405 up to each edge of the first base member 405 as well as the entire height of the first base member 405. That is, the rubber strip member 415 is configured in a shape substantially corresponding to the shape of the first base member 405. The second rubber strip member 420 extends across the entire width of the second base member 410 up to each edge of the second base member 410 as well as the entire height of the second base member 410. That is, the second rubber strip member 420 is configured in a shape substantially corresponding to the shape of the second base member 410.

As illustrated in FIGS. 10-12 and provided in the corresponding description, the first rubber strip member 415 and the second rubber strip member 420 can vary in shape, material, size, number and placement of rubber strips according to the embodiments thereof.

In certain embodiments, the first base member 405 is configured to wrap around a user's natural hair with the first rubber strip member 415 of the first base member 405 being in contact with the user's natural hair. In certain embodiments, the second base member 410 is configured to wrap around the first base member 405 with the second rubber strip member 420 of the second base member 410 being in contact with the artificial hair coupled to the first base member 405.

In certain embodiments, the first rubber strip member 415 extends across the width of the first base member 405 up to substantially each of the first side edges of the first base member 405 and less than the entire height of the first base member 405.

In certain embodiments, the first rubber strip member 415 extends across the first base member 405 a distance less than the entire width.

In certain embodiments, the second rubber strip member 420 extends across the width of the second base member 410 up to substantially each of the second side edges of the second base member and less than the height of the second base member 410.

In certain embodiments, the second rubber strip member 420 extends across the second base member 410 a distance less than the entire width.

In certain embodiments, the first rubber strip member 415 comprises multiple first rubber strip members, and at least two of the first rubber strip members comprise a space therebetween.

In certain embodiments, the first rubber strip member 415 is configured in a shape substantially corresponding to the shape of the first base member 405. In certain embodiments, the second rubber strip member 420 is configured in a shape substantially corresponding to the shape of the second base member 410.

Figure 13:
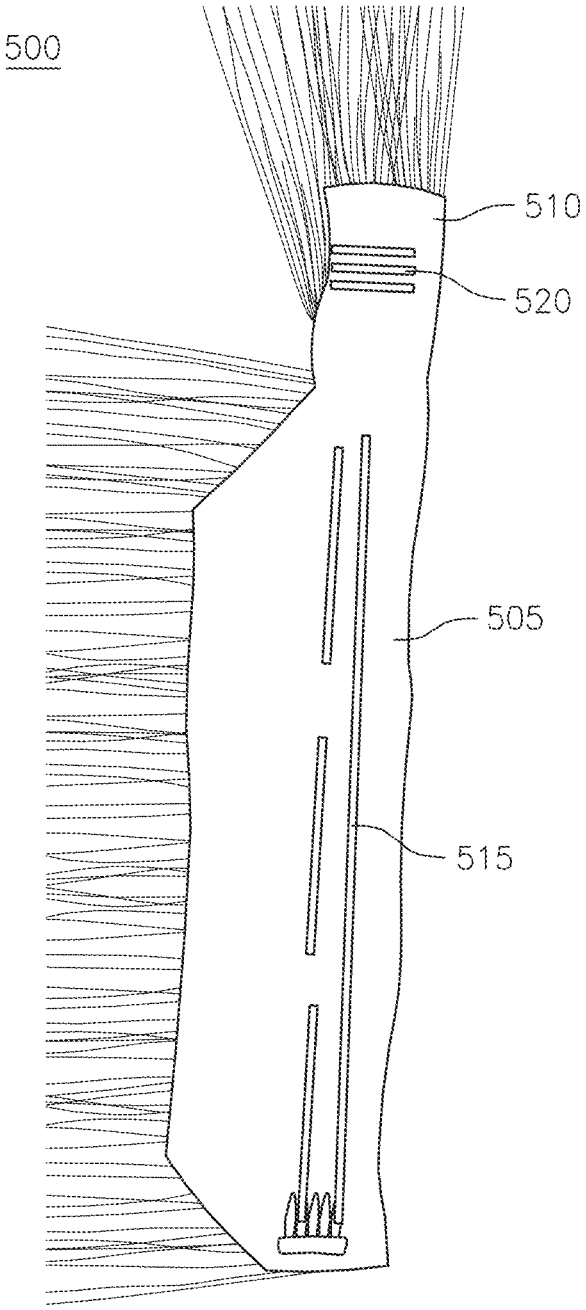
FIGS. 13 and 14 illustrate alternative embodiments of a hair extension apparatus in which a first base member includes a first filament section and a second base member includes a second filament section.
Figure 14:
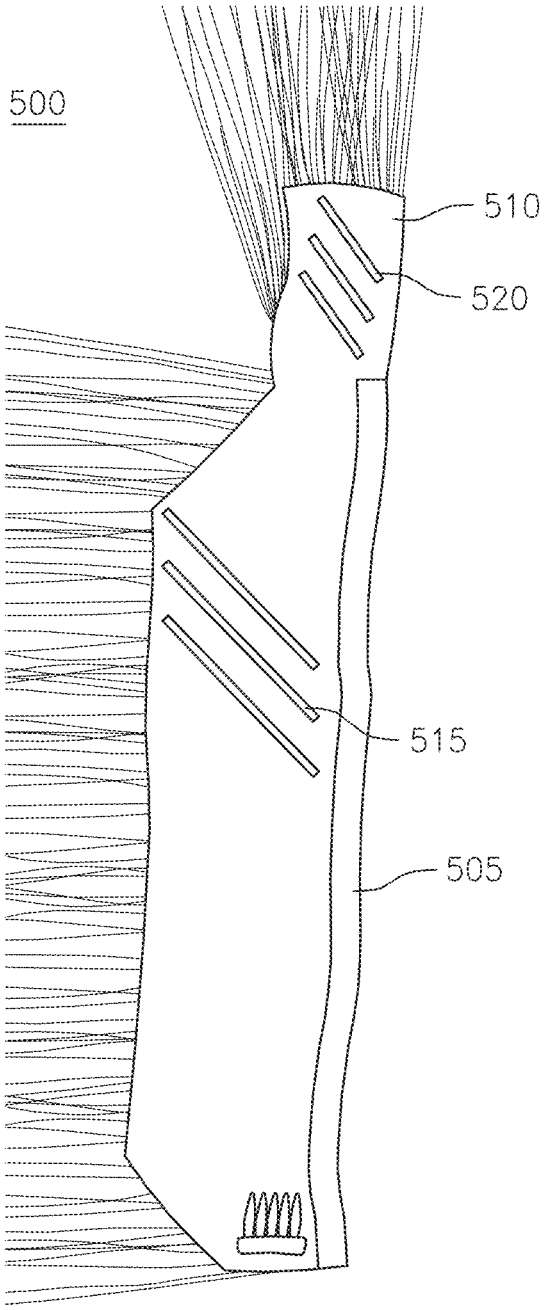

FIGS. 13 and 14 illustrate alternative embodiments, which can be implemented in each of the above-described embodiments, of a hair extension apparatus 500 in which a first base member 505 includes a first filament section 515 and a second base member 510 includes a second filament section 520. In FIGS. 13 and 14, the first filament section 515 and the second filament section 520 are highlighted for purposes of illustration. The first filament section 515 is coupled to the first base member 515. The second filament section 520 is coupled to the second base member 510. As illustrated in FIG. 13, the first filament section 515 is coupled to the first base member 505 in an orientation parallel to the front edge of the first base member 505 and the second filament section 520 is coupled to the second base member 510 in an orientation parallel to the front edge of the second base member 510. As illustrated in FIG. 14, the first filament section 515 is coupled to the first base member 505 in an orientation diagonal to the front edge of the first base member 505 and the second filament section 520 is coupled to the second base member 510 in an orientation diagonal to the front edge of the second base member 510. In certain embodiments, the first filament section 515 and the second filament section 520 are coupled to the first base member 505 and the second base member 510, respectively, in a perpendicular orientation.

In certain embodiments, the first filament section 515 and the second filament section 520 are coupled to the first base member 505 and the second base member 510, respectively, in different directions. For example, the first filament section 515 is coupled to the first base member 505 in a parallel orientation and the second filament section 520 is coupled to the second base member 510 in a perpendicular orientation. For example, the first filament section 515 is coupled to the first base member 505 in a perpendicular orientation and the second filament section 520 is coupled to the second base member 510 in a parallel orientation. For example, the first filament section 515 is coupled to the first base member 505 in a diagonal orientation and the second filament section 520 is coupled to the second base member 510 in a parallel orientation. For example, the first filament section 515 is coupled to the first base member 505 in a parallel orientation and the second filament section 520 is coupled to the second base member 510 in a diagonal orientation. For example, the first filament section 515 is coupled to the first base member 505 in a perpendicular orientation and the second filament section 520 is coupled to the second base member 510 in a diagonal orientation. For example, the first filament section 515 is coupled to the first base member 505 in a diagonal orientation and the second filament section 520 is coupled to the second base member 510 in a perpendicular orientation.

Figure 15:
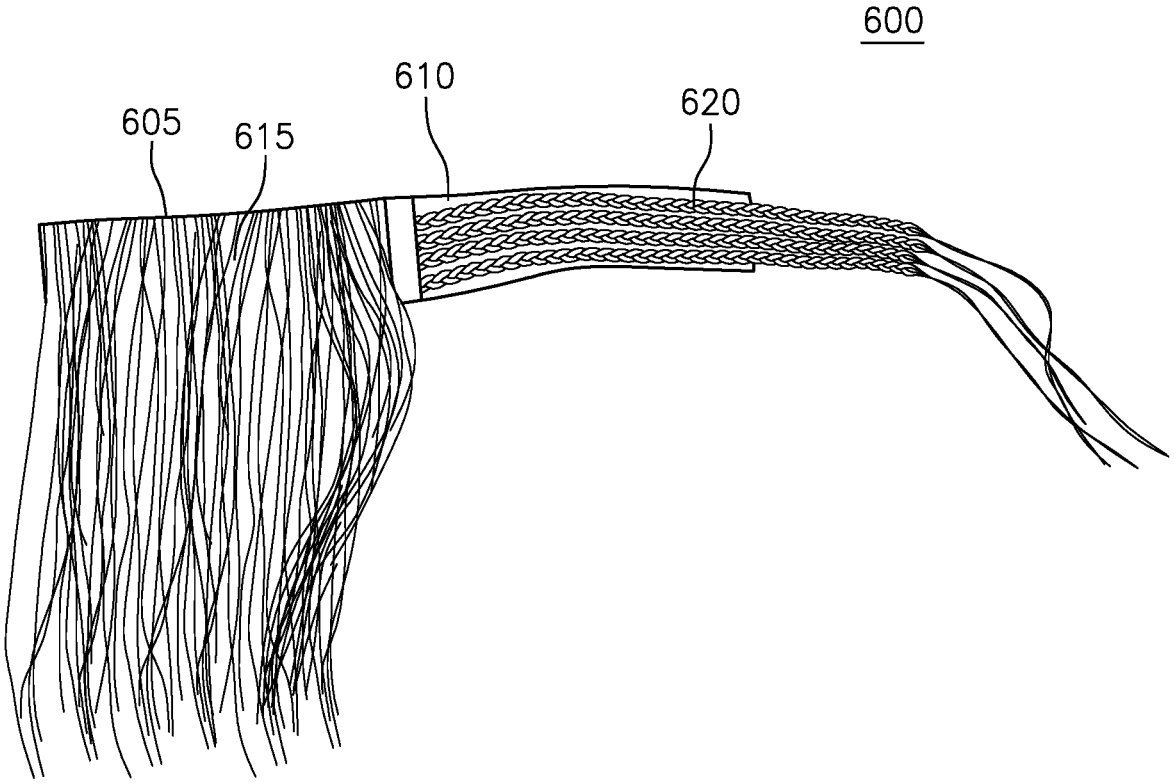
FIGS. 15 and 16 illustrate an alternative embodiment of a hair extension apparatus in which artificial hair coupled to a second base member is braided.
Figure 16:
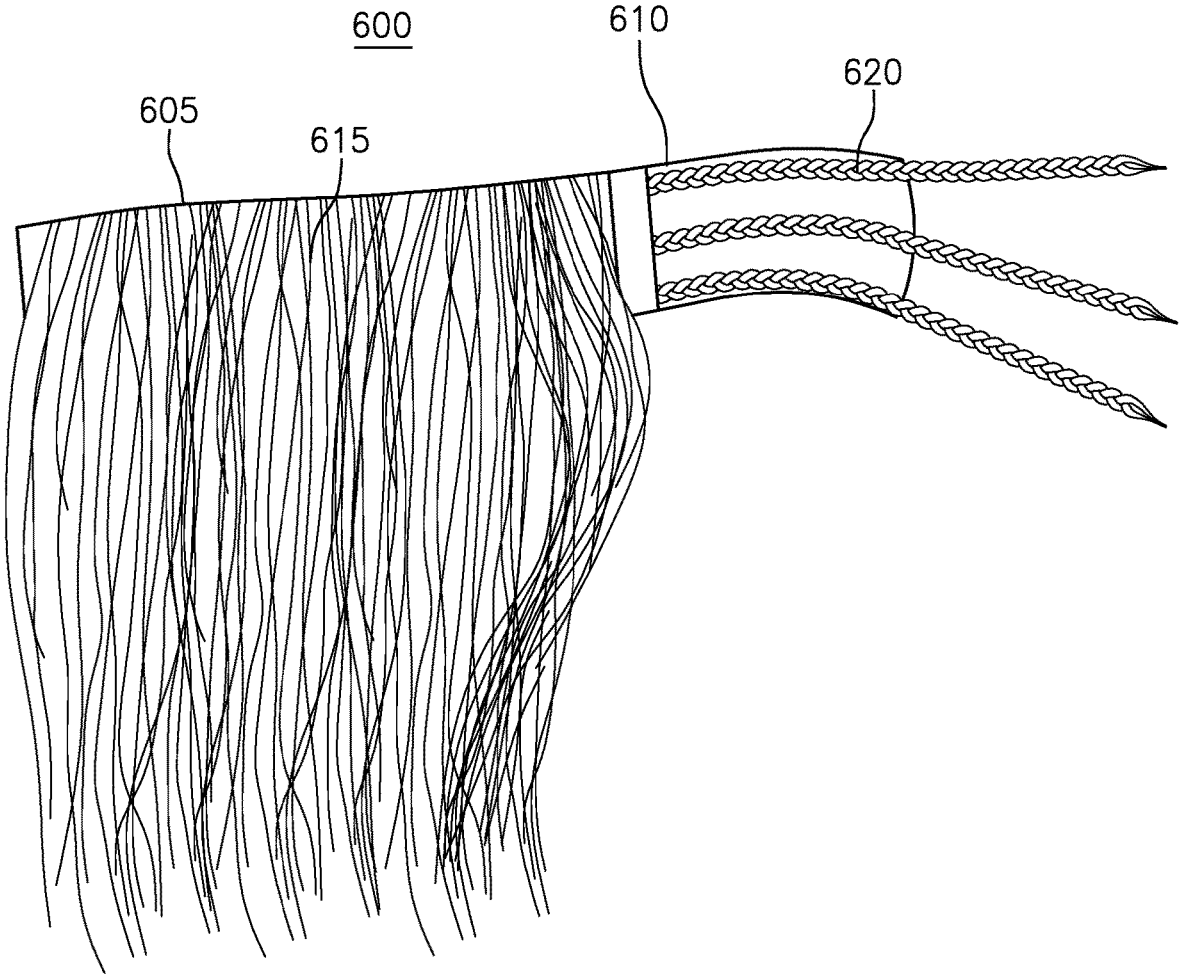

FIGS. 15 and 16 illustrate an alternative embodiment of a hair extension apparatus 600. The hair extension apparatus 600 includes a first base member 605 and a second base member 610. A first artificial hair section 615 is coupled to the first base member 605. A second artificial hair section 620 is coupled to the second base member 610. The artificial hair of the first artificial hair section 615 includes individual strands of artificial hair. The artificial hair of the second artificial hair section 620 includes individual strands of artificial hair. As illustrated in FIG. 15, the artificial hair of the second artificial hair section 620 coupled to the second base member 610 is braided. That is, individual strands of artificial hair coupled to the outer surface of the second base member 610 are braided. As illustrated in FIG. 16, the second artificial hair section 620 is configured as pre-made artificial hair wefts braided into multiple braids that are coupled to the outer surface of the second base member 610. In both embodiments illustrated in FIGS. 15 and 16, the braids of the second hair section 620 are wrapped around the first artificial hair section 615, as described above with respect to the other embodiments. Furthermore, the number, style and thickness of the braids in the second artificial hair section 620 can very according to individual preferences and applications.

According to the embodiments of the invention described herein, a hair extension apparatus that is coupled to a user's natural hair is provided. As described herein, the hair extension apparatus includes various components configured to securely couple the hair extension apparatus to the user's natural hair, while also providing a desirable and fashionable appearance.

While embodiments of the invention have been shown and described with reference to certain embodiments thereof, it will be understood by those skilled in the art that various changes in form and details may be made therein without departing from the spirit and scope of the invention and equivalents thereof.

What is claimed is:

1. A hair extension apparatus, comprising:

a first base member comprising a first front edge, a first rear edge, a first side edge, a first top surface and a first bottom surface;

a second base member comprising a second front edge, a second rear edge, a second side edge, a second top surface and a second bottom surface, wherein the second base member is coupled to the first base member;

a first artificial hair section comprising artificial hair, wherein the first artificial hair section is coupled to the first top surface of the first base member;

a second artificial hair section comprising artificial hair, wherein the second artificial hair section is coupled to the second top surface of the second base member;

a first fastener member coupled to the first side edge on the first bottom surface of the first base member; and a second fastener member coupled to the first bottom surface of the first base member, wherein the second fastener member is a second comb comprising tines, wherein the first fastener member is disposed opposite to the second base member, wherein the first fastener member is a first comb comprising tines, and wherein the tines of the first comb face towards the second base member.

2. The hair extension apparatus according to claim 1, wherein the tines of the first comb are disposed perpendicular to the tines of the second comb.

3. The hair extension apparatus according to claim 2, wherein the first artificial hair section comprises individual strands of artificial hair coupled to a first filament section, and wherein the first filament section is coupled to the first base member.

4. The hair extension apparatus according to claim 3, wherein the first filament section is coupled to the top surface of the first base member in multiple rows.

5. The hair extension apparatus according to claim 3, wherein the first filament section is coupled to the first base member in one of a parallel, perpendicular and diagonal orientation with respect to the first front edge.

6. The hair extension apparatus according to claim 3, wherein the second artificial hair section comprises individual strands of artificial hair coupled to a second filament section, and wherein the second filament section is coupled to the second base member.

7. The hair extension apparatus according to claim 6, wherein the second filament section is coupled to the top surface of the second base member in multiple rows.

8. The hair extension apparatus according to claim 6, wherein the second filament section is coupled to the second base member in one of a parallel, perpendicular and diagonal orientation with respect to the second front edge.

9. The hair extension apparatus according to claim 3, wherein the first filament section is coupled to the first base member with respect to the first front edge in an orientation different from an orientation in which the second filament section is coupled to the second base member with respect to the second front edge.

10. The hair extension apparatus according to claim 1, wherein the artificial hair of the first artificial hair section extends in a direction perpendicular to a direction in which the artificial hair of the second artificial hair section extends.

11. The hair extension apparatus according to claim 1, wherein the first top surface comprises a greater surface area than the second top surface.

12. The hair extension apparatus according to claim 1, wherein the first front edge is substantially perpendicular to the second front edge, and wherein the first rear edge is substantially perpendicular to the second rear edge.

13. The hair extension apparatus according to claim 1, wherein the artificial hair of the first artificial hair section extends at least partially beyond the first rear edge, and wherein the artificial hair of the second artificial hair section extends at least partially beyond the second rear edge.

14. The hair extension apparatus according to claim 1, wherein the first base member is configured to wrap around a user's natural hair, with the first bottom surface of the first base member being in contact with the user's natural hair, and wherein the second base member, and the artificial hair extending therefrom, is configured to wrap around the first base member, with the second bottom surface of the second base member being in contact with the first artificial hair section.

15. The hair extension apparatus according to claim 1, wherein a portion of the second top surface of the second base member is free of artificial hair.

16. The hair extension apparatus according to claim 1, wherein the first base member and the second base member are constructed of separate pieces of material.

17. The hair extension apparatus according to claim 1, wherein at least a portion of the second base member is constructed of an elastic material.

18. A hair extension apparatus, comprising:

a first base member comprising a first front edge, a first rear edge, a first side edge, a first top surface and a first bottom surface;

a second base member comprising a second front edge, a second rear edge, a second side edge, a second top surface and a second bottom surface, wherein the second base member is coupled to the first base member;

a first artificial hair section comprising artificial hair, wherein the first artificial hair section is coupled to the first top surface of the first base member;

a second artificial hair section comprising artificial hair, wherein the second artificial hair section is coupled to the second top surface of the second base member; and a first fastener member coupled to the first side edge on the first bottom surface of the first base member, wherein the first fastener member is disposed opposite to the second base member, wherein the first fastener member is a first comb comprising tines, and wherein the tines of the first comb face towards the second base member, and wherein the first base member is configured to wrap around a user's natural hair, with the first bottom surface of the first base member being in contact with the user's natural hair, and wherein the second base member, and the artificial hair extending therefrom, is configured to wrap around the first base member, with the second bottom surface of the second base member being in contact with the first artificial hair section.

19. The hair extension apparatus according to claim 18, wherein the first artificial hair section comprises individual strands of artificial hair coupled to a first filament section, and wherein the first filament section is coupled to the first base member.

20. The hair extension apparatus according to claim 18, wherein the first filament section is coupled to the top surface of the first base member in multiple rows.

21. The hair extension apparatus according to claim 20, wherein the first filament section is coupled to the first base member in one of a parallel, perpendicular and diagonal orientation with respect to the first front edge.

22. The hair extension apparatus according to claim 20, wherein the second artificial hair section comprises individual strands of artificial hair coupled to a second filament section, and wherein the second filament section is coupled to the second base member.

23. The hair extension apparatus according to claim 22, wherein the second filament section is coupled to the top surface of the second base member in multiple rows.

24. The hair extension apparatus according to claim 22, wherein the second filament section is coupled to the second base member in one of a parallel, perpendicular and diagonal orientation with respect to the second front edge.

25. The hair extension apparatus according to claim 18, wherein the artificial hair of the first artificial hair section extends in a direction perpendicular to a direction in which the artificial hair of the second artificial hair section extends.

26. The hair extension apparatus according to claim 18, wherein the first top surface comprises a greater surface area than the second top surface.

27. The hair extension apparatus according to claim 18, wherein the first front edge is substantially perpendicular to the second front edge, and wherein the first rear edge is substantially perpendicular to the second rear edge.

28. The hair extension apparatus according to claim 18, wherein the artificial hair of the first artificial hair section extends at least partially beyond the first rear edge, and wherein the artificial hair of the second artificial hair section extends at least partially beyond the second rear edge.

29. The hair extension apparatus according to claim 18, wherein the first base member and the second base member are constructed of separate pieces of material.

30. The hair extension apparatus according to claim 18, wherein at least a portion of the second base member is constructed of an elastic material.

* * * * *